United States Patent [19]

Mikus et al.

[11] 4,321,876

[45] Mar. 30, 1982

[54] SYSTEM FOR THE REMOVAL OF ASH

[75] Inventors: William S. Mikus, Granby; Anthony J. Cozza, West Hartford; Harold E. Collins, II, Enfield, all of Conn.; Gerald A. Mellinger, Noblesville, Ind.

[73] Assignee: Combustion Engineering, Inc., Windsor, Conn.

[21] Appl. No.: 122,384

[22] Filed: Feb. 19, 1980

[51] Int. Cl.[3] ..... F23J 1/02; F23J 1/00

[52] U.S. Cl. ..... 110/171; 110/165 R; 126/242

[58] Field of Search ..... 110/171, 165 R; 126/242

[56] References Cited

U.S. PATENT DOCUMENTS

| | | | |
|---|---|---|---|
| 1,957,583 | 5/1934 | Foresman | 110/171 |
| 3,771,470 | 11/1973 | Hampton | 110/171 |
| 4,018,588 | 4/1977 | Hardy, Jr. | 110/171 |
| 4,112,856 | 9/1978 | Fuhrman et al. | 110/171 |
| 4,166,421 | 9/1979 | Stribling | 110/171 |

*Primary Examiner*—Albert W. Davis
*Assistant Examiner*—Wesley S. Ratliff, Jr.
*Attorney, Agent, or Firm*—Arthur L. Wade

[57] ABSTRACT

A structure for impounding liquid is disclosed below the combustion chamber of a steam generator. The structure divides the impounded liquid in two sections, or pools. The first section, or pool, receives the hot residue gravitated from the combustion chamber and absorbs the thermal and mechanical shock of the residue. The second section, or pool, is connected to the first pool through a gate valve and contains a continuous conveyor which transports the cooled residue, received from the first pool, to a point of ultimate disposal.

4 Claims, 2 Drawing Figures

SYSTEM FOR THE REMOVAL OF ASH

TECHNICAL FIELD

The present invention relates to receiving hot, solid residue from the combustion chamber of a steam generator gravitated to the bottom in a body of water and the transmission of the cooled, solid material to a point of disposal by continuous transport. The invention further relates to a pool system for the reception of hot, solid furnace waste in an initial position within one pool which can be sealed from communication with a second pool to which the cooled waste is transferred for continuous conveyance to a point of ultimate disposal.

BACKGROUND ART

The utility steam generator is characterized by a massive vessel often extending vertically many stories. This vessel customarily has its internal walls lined with pipes, the water passing through these pipes being heated to convert the water into steam. Various types of fuel are burned in the lower portions of these containers to generate the heat transferred through the pipe walls. Of these fuels, pulverized coal probably leaves the most ash, or solid residue, clinging to the walls.

The type of fuel burned depends on availability. Certainly, pulverized coal continues to play an important part in supplying the thermal energy needed to produce steam in these utility generators. Therefore, the relatively large quantities of residue must be provided disposal systems for this particulate material as it gravitates to the bottom of the utility boiler.

Whether the solid material left from the pulverized coal combustion in the generator is described as slag, cinder, ash or residue, there is general agreement that it is heavy, hot and abundant. This particulate material is deliberately sloughed, or forced, from the walls of utility generators and falls toward the bottom of the generator container. It is a distinctive art to handle this material, store it, reduce its temperature, remove it from the furnace and transport it to a collection station from which it may be safely carried in bulk to an ultimate destination.

In this art, it is known to have pools of water to receive the solid residue falling to the bottom of a utility generator. Additionally, provisions have been made for holding the particulate material in a collection and periodically releasing some or all of the collection to a conveyor system. The present problem is to combine the structures for providing the water pool, storage containers, and conveyor systems in a way which will enable inspection, repair, and replacement of the conveyor system without interruption of the combustion process of the utility generator.

Other objects, advantages and features of this invention will become apparent to one skilled in the art upon consideration of the written specification, appended claims and attached drawings.

BEST MODE FOR CARRYING OUT THE INVENTION

In the interest of maintaining consistent terminology, it is to be understood that the designations boiler, furnace, generating section and combustion chamber are all equivalent for the purposes of the present disclosure. These terms refer to a container whose internal walls are lined with pipes through whose walls heat is absorbed from the combustion process sustained in the container to convert water in the pipes into steam. The initial concern of the disclosure is with the residue on the internal walls of this container which is inevitably dislodged and gravitates to the bottom of the container.

The residue of the combustion process may be termed slag, cinders, ash, particulate or solids. Particularly with the use of pulverized coal, large quantities of this material precipitate from the gaseous products of combustion and cling to the internal walls of the chamber in which the combustion is sustained. If this material accumulates, it may by its own weight slough from the walls to which it clings and gravitate to the bottom of the combustion chamber in the form of hot masses requiring temperature reduction, absorption of gravitational energy and disposal. Also, this material may be deliberately dislodged from the walls to which it clings and fall toward the bottom of the container.

In disclosing the invention, reference will be made to either a pool of liquid considered in two sections or two pools of liquid connected for the exchange of the solid material from the first pool to the second pool. In either event, both the sections and the pools are mechanically separated to provide a seal between them.

Figure 1:
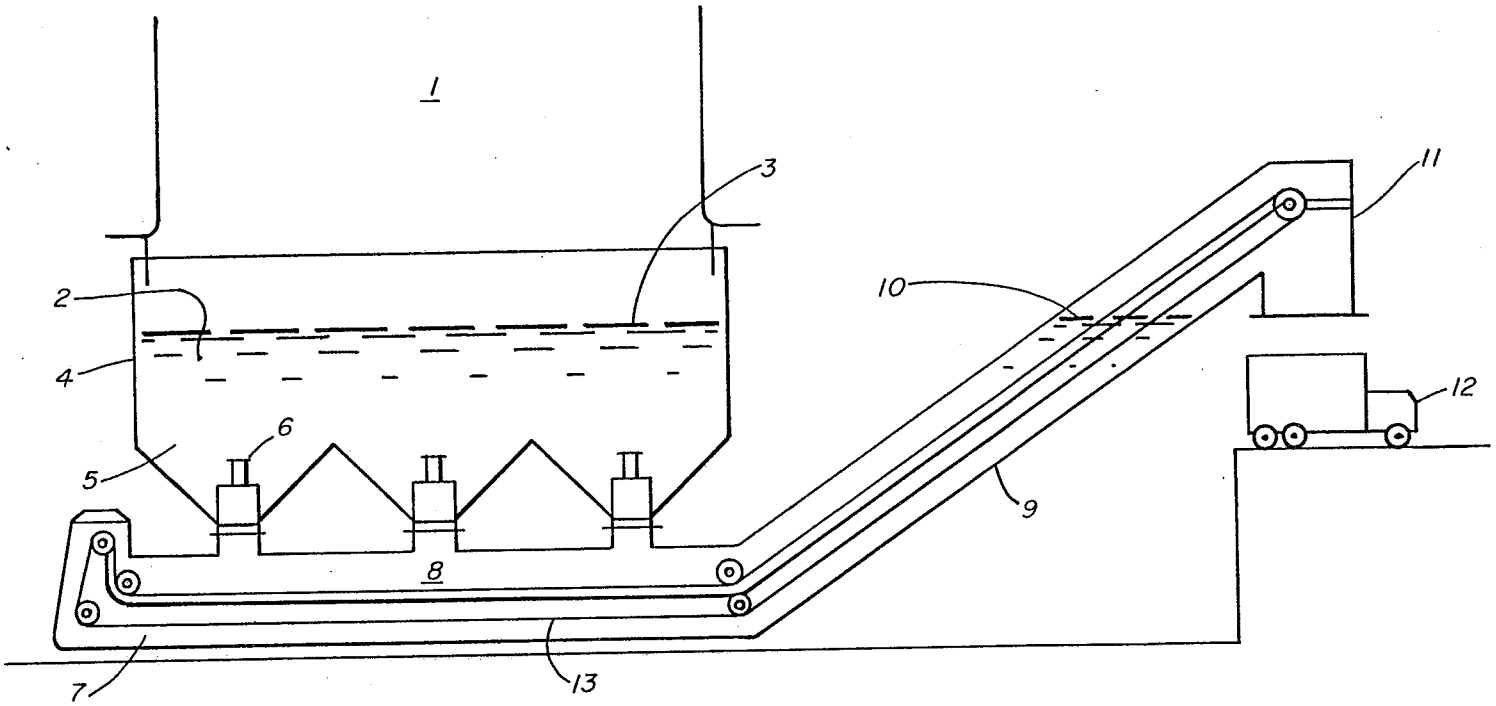
FIG. 1 is a sectioned side elevation of a system connected to the lower portion of a utility generator for receiving hot residue from the combustion chamber of the generator and transporting it to a disposal point with structure embodying the present invention.

With an economy of drawing disclosure, FIG. 1 represents the lower portion of a combustion chamber at 1. It serves no purpose to illustrate the complete generator represented by 1 and from which the hot solid residue descends to this lower portion of the container.

What is important is a pool of liquid impounded below the combustion chamber of generator 1. This pool of water 2 has a surface 3. The depth of this pool, that is the distance between surface 3 and the bottom of the structure impounding the pool, may vary. However, that depth is established which will provide a sufficiently large quantity of liquid to absorb the mechanical shock of the falling residue, while quenching the temperature of the hot residue. Quenching the residue suddenly will, hopefully, cause its fragmentation for ready subsequent handling.

There is no practical way of salvaging the heat of the solid material. Broadly, all that can be done is to quench the temperature of the material in the pool of liquid and absorb the gravitational energy of its fall in order to avoid mechanical damage to the structure impounding pool 2.

The solid material gravitates to the bottom of liquid-impounding structure 4. The bottom of structure 4 comprises one or more v-shaped hoppers 5 into which the solid residue is guided. The hoppers 5 are essentially receptacles with bottom sluice gates 6 which remain open during normal operation to maintain transfer of the solid material from structure 4 into lower liquid-impounding structure 7.

Below liquid-impounding structure 4, with sluice gates 6, is connected liquid-impounding structure 7.

Thus, the two impounding structures 4 and 7 are connected, communicated through sluice gate 6. From one viewpoint, there has been disclosed a single pool of liquid with an upper section 2 impounded by structure 4 and second section 8 impounded by structure 7. Logically, the disclosure could be looked upon as having a first pool 2 impounded by structure 4 and a second pool 8 impounded by structure 7. From either view, the two sections of the same pool, or the two pools, are communicated with each other through sluice gates 6.

Impounding structure 7 in FIG. 1 is in the form of an elongated trough, conduit or passage which extends horizontally beneath hoppers 5 and then deviates upward at an angle above the surface 3. For clarity, the upward extension of the impounding structure 7 is designated 9, with the surface of its liquid at 10. The height of surface 10 is, of course, equal to that of surface 3 because the pools, or sections, are normally communicated through sluice gates 6. The elevated end of upwardly inclined structure 9 terminates in a downwardly directed extension 11, beneath which can be accommodated automotive transports 12.

Figure 2:
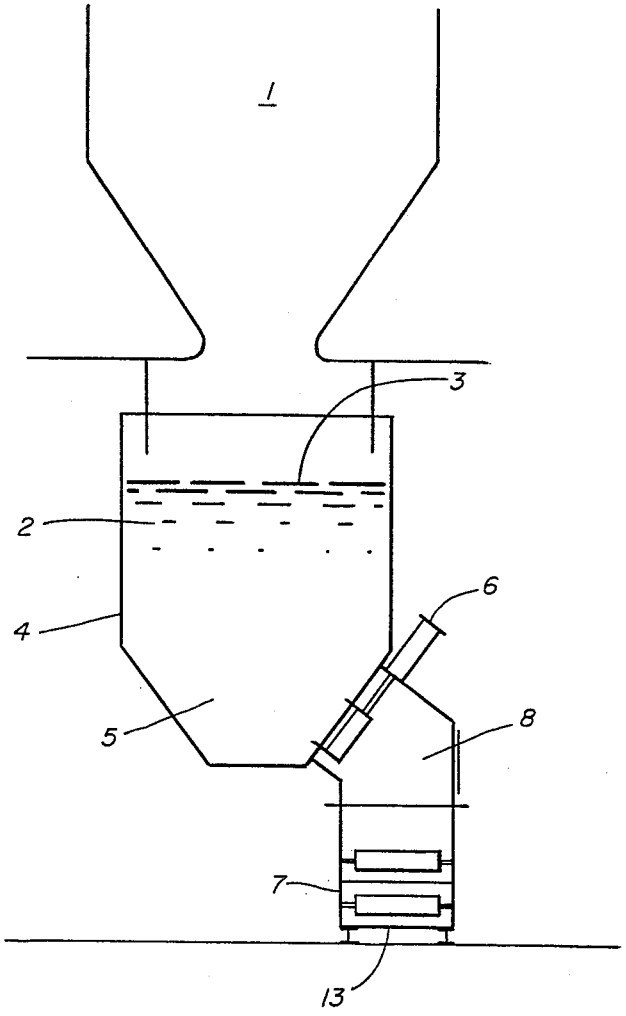
FIG. 2 is a sectioned end elevation of the structure of FIG. 1 disclosing the mechanical conveyor in the lower pool of water.

Taking both FIGS. 1 and 2 together, there is disclosed a continuous conveyor structure 13 which is mounted along the bottom of impounding trough 7 and upwardly inclined portion 9. The arrangement and operation of the conveyor structure 13 moves any solid residue in passage 7 to above surface 10 and into waiting motor transports 12.

If not by now self-explanatory, the operation of the disclosed structure is seen to begin with the gravitation of the solid residue of generator 1 into pool 2. Pool 2 is designed with a depth which will absorb the thermal and physical stress generated by the fall of solid residue toward surface 3. The result of bringing the liquid of pool 2 into sudden contact with the hot residue may be spectacular. Nevertheless, it is shielded from the eyes of external observers. The practical result sought and attained is the drastic reduction of the temperature of this material and the controlled collection by the sloping sides of hoppers 5 located at the bottom of pool 2.

Normally, it is expected that sluice gates 6 will be maintained in their open position. Solid residue, cooled and settled through liquid body 2, is expected to transfer through the opening of sluice gates 6 into the impounded pool of liquid within structure 7.

The solid ash from the furnace, now brought under thermal and gravitational control, is expected to continuously drain from the hoppers 5 into liquid pool 8 and on to the waiting surface of continuous conveyor 13. Normally, conveyor 13 continuously operates to move the solid residue along the trough or passage of 7, up extension 9, and down extension 11. As the residue on the conveyor leaves surface 10, a large portion of the liquid drains from it, leaving a sodden manageable mass which can be safely dumped down extension 11 and into transports 12. The use of this waste material is not of concern in this disclosure. It is removed to some ultimate destination. Thus, disposal of the residue of the combustion within generator 1 is completed.

The disclosure of FIGS. 1 and 2 clearly brings about the best features of preceding systems. The liquid pool system is combined with the storage and continuous conveyor systems of the prior art in a unique combination.

The maintenance, repair and replacement of the many parts of the conveyor structure 13 present a significant problem. The disclosure arrangement provides access to this conveyor 13 without interruption of the combustion process in generator 1. It is necessary to maintain the combustion chamber of the generator sealed to prevent upset in the operation of the combustion process. The present invention provides this seal by sluice gate 6. Although normally open, sluice gates 6 are readily closed. Sluice gates 6 are liquid-tight. When sluice gates 6 are closed, the impounding structure 7 can be drained of the liquid of pool 8 and provide ready access to the maintenance, repair and replacement of conveyor 13.

Throughout the disclosure, for reference, pools 2 and 8 have been referred to as "liquid". Of course, the most logical liquid to use is the readily available water. However, the term liquid has been used in an effort to clear the fact that the invention is not limited to the specific use of water for the purposes served by pools 2 and 8.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

We claim:

1. A structure for disposing of solid residue material from a combustion process including, a combustion chamber in which solid residue material gravitates from the walls toward the bottom of the chamber, a first structure for impounding a pool of liquid mounted at the bottom of the combustion chamber to receive the solid residue material, a first pool of liquid within the first impounding structure and having a predetermined depth, a second structure for impounding a pool of liquid mounted below the first impounding structure and connected to the first impounding structure through an opening in the bottom of the first impounding structure, a second pool of liquid within the second impounding structure arranged to receive the solid residue material from the first pool of water, means for liquid sealing the opening in the bottom of the first impounding structure through which the residue passes from the first pool to the second pool, and a mechanical conveyor mounted in the second impounding structure and arranged to receive the solid residue material discharged from the first pool and transport the solid residue material to a station above the level of the pool surfaces.

2. The disposal structure of claim 1 in which the liquid is water.

3. The disposal structure of claim 1 in which the second impounding structure includes a portion extending upward and within which the second pool of liquid is provided with a surface on a level with the surface of the first pool of liquid and the conveyor extends along the bottom of the second impounding structure below the opening in the first impounding structure and along the upwardly extending portion to above the surface of the second pool of water.

4. The system of claim 3 in which the liquid is water.

* * * * *